US005485773A

United States Patent [19]

Devitrysmith

[11] Patent Number: 5,485,773

[45] Date of Patent: Jan. 23, 1996

[54] GUITAR STRING INSTALLATION AND ADJUSTMENT MECHANISM

[76] Inventor: Terry J. Devitrysmith, 17005 NE. 101st Pl., Redmond, Wash. 98052

[21] Appl. No.: 386,523

[22] Filed: Feb. 6, 1995

[51] Int. Cl.[6] ..... G10D 1/08

[52] U.S. Cl. ..... 84/267; 84/297 R; 84/304

[58] Field of Search ..... 84/267, 297 R, 84/304

[56] References Cited

U.S. PATENT DOCUMENTS 4,576,080 3/1986 McLellan et al. ..... 84/267

*Primary Examiner*—Patrick J. Stanzione
*Attorney, Agent, or Firm*—Robert W. Jenny

[57] ABSTRACT

The mechanism includes an assembly which fits in a notch in the bottom of the body of a guitar to carry the strings around the bottom in order to allow the guitar to be as short as feasible while having standard effective string lengths. This assembly includes features which allow independent adjustments for each string of the effective length of the string and distance of the string from its associated electronic pickup. The assembly is made up of a base and six roller assemblies. Each roller assembly carries a string around the bottom of the body. The base has two flanges with six set screws in each flange and each roller assembly rests on the ends of two set screws, one in each flange and is held in place by the string. One set screw adjusts the effective string length, the other the distance of the string from its pickup. The knobs for the tuning machines of the guitar are distributed around the top edge of the front face of the body of the guitar.

2 Claims, 6 Drawing Sheets

GUITAR STRING INSTALLATION AND ADJUSTMENT MECHANISM

BACKGROUND OF THE INVENTION

1. Field

The subject invention is in the field of stringed musical instruments, particularly guitars. More particularly it is in the field of electric guitars and still more particularly electric guitars which are made as compact as feasible while incorporating a full scale effective string length.

2. Prior Art

The prior art which is closest to the subject invention and known to the inventor of the subject invention is disclosed in U.S. Pat. No. 4,576,080, titled Guitars, issued to W. S. McLellan et al. and now expired. The '080 guitars are compact and are made so primarily by routing the strings across the front faces of the bodies of the bodies and around the ends of the guitars to tuning machines on the backs of the bodies. The tuning machines are operated by knobs installed along one of the sides of the bodies.

Detailed examination of the '080 guitars brings out detail features, discussed in more detail later in this disclosure, which limit the utility and compactness of the guitars. Briefly and specifically, (1) the knobs of the tuning machines are not readily accessible when the instrument is being played or held ready to be played, (2) the distance of each string from its pick up is not individually adjustable, and (3) the mechanisms which carry the strings around the bottoms of the guitars render the guitars longer than necessary; i.e. not as compact as possible.

Accordingly, the primary objective of the subject invention is to provide a compact electric guitar which (1) has tuning machine knobs which are readily accessible when the guitar is being held in the playing position, (2) the distance of each string from its associated electronic pick up is individually adjustable, (3) the mechanism which carries the strings from the front face of the body to the back of the body and the tuning machines enable independent adjustment of the effective length of each string, and (4) the length of the guitar on which the mechanism is installed is only minimally greater than the effective lengths of the strings.

SUMMARY OF THE INVENTION

The subject invention is mechanism used for the installation and adjustment of strings on a compact electric guitar. A typical compact electric guitar comprises primarily a neck, a body, six strings and six tuning machines. The body is generally flat and has a front, a back, a bottom, a top and two sides the neck extends from the top. The effective lengths of the strings are conventional. The strings are anchored at the free end of the neck, pass over the fretted surface of the neck, across the front of the body over the electrical pickups and around the bottom of the guitar body to be engaged by the tuning machines on the back. The plan view shape of the subject guitar can be described as basically rectangular with generously radiused corners, the radius of each corner being about ⅜ of the distance from side to side of the body. The tuning machines are installed into the front of the body with three machines in each of the radiused corners of the top of the body, with the operating keys extending radially to one side of the body. Located thus they are optimally accessible for tuning adjustments when the guitar is being held in the conventional playing position.

The pick up assembly is installed in the lower half of the front of the body and the strings pass over the pick ups and around the bottom of the body to the tuning machines. The mechanism which carries the strings around the bottom enables adjustment of the effective length of each individual string and the distance of each individual string from the pick up which serves it. For purposes of this disclosure this mechanism is termed the carrier assembly. The carrier assembly comprises a base and six roller assemblies, one for each string. The carrier assembly is installed in a notch in the bottom of the body. The base is essentially a rectangular metal plate which nests in and covers the bottom of the notch and is fastened in place by countersunk threaded fasteners. The top edge of the base is flanged and this top flange extends a short distance over and rests on the front of the body. The bottom edge of the base is also flanged with the bottom surface of the bottom flange being essentially flush with the adjacent portion of the back of the body and with the flange extending away, downward from the body. There are six threaded holes in the top flange, one under each string and with their axes parallel to the longitudinal axis of the guitar. There are also six threaded holes in the bottom flange, each hole centered under a string and with their axes perpendicular to the front and back surfaces of the body. There is an Allen socket head set screw installed in each threaded hole.

Each roller assembly comprises a carriage and four roller subassemblies. Each roller subassembly comprises a roller and an axle. The carriage has a U-shaped cross section with right angle corners between the sides and bottom of the U-shape. In plan view the carriage is a chordal segment of a circle; however, the chordal face is stepped with the step about one fourth of the length of the chord from one end of the carriage. The carriage is beveled at the other end to form a V-shape at the juncture of the circular edges of the flanges and the surface of the chordal face. The roller subassemblies are installed with their axes bridging the gap between the sides of the roller assemblies and located so that the surfaces of revolution of the rollers are essentially flush with the circular edges of the flanges.

The roller subassemblies are installed in the notch with their ledges resting on the set screws in the bottom flange of the base and their chordal faces near their beveled ends against the ends of the set screws in the top flange of the base. Each roller subassembly is held in place by a string stretched over it, contacting the beveled end, each roller and the bottom end and then extending to a tuning machine. Turning the set screws in the top flange moves the beveled ends of the carrier assemblies toward or away from the base, adjusting the effective length of the strings. Turning the set screws in the lower flange of the base raises and lowers the roller assemblies to adjust the distances of the strings from the pickups.

The invention is described in more detail below with reference to the attached drawings.

DETAILED DESCRIPTION OF THE INVENTION

Figure 1:
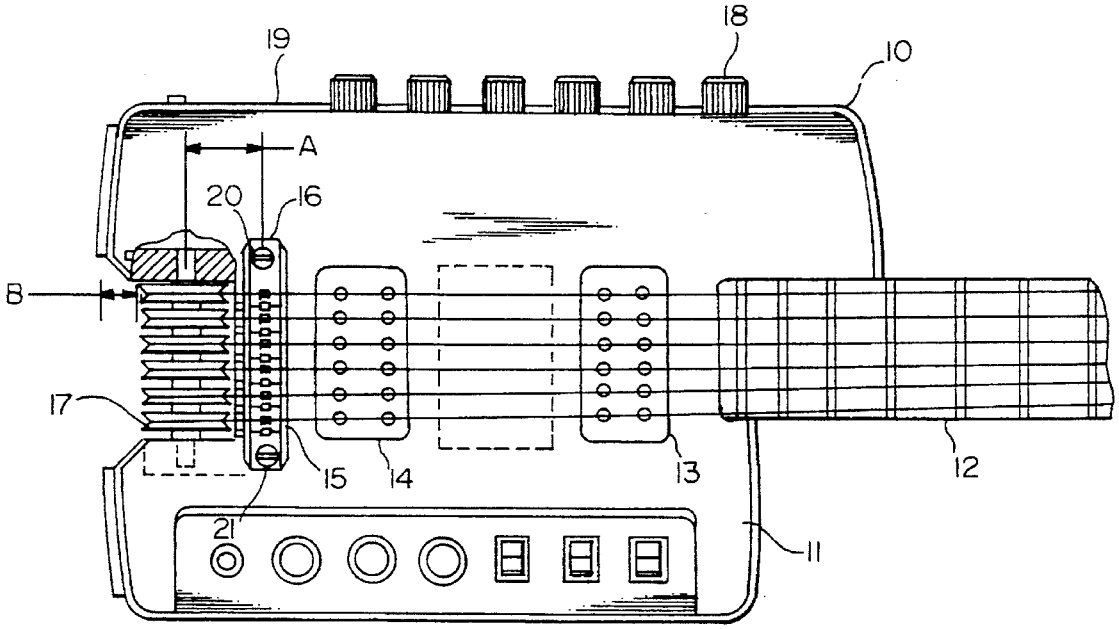
FIG. 1 PRIOR ART
FIG. 1 is a reproduction of FIG. 3 of U.S. Pat. No. 4,578,080, issued to McClellan et al. and now expired.

The subject invention is installation and adjustment mechanism for the strings of a compact electric guitar. FIG. 1, a reproduction of FIG. 3 of U.S. Pat. No. 4,576,080 (now expired), illustrates a prior art compact guitar and some features of the mechanisms used for installing and adjusting the strings of that guitar. The guitar 10 in FIG. 1 is seen in this view from the front 11. The strings, string 12 being typical, pass over pick ups 13 and 14 and small rollers, roller 15 being typical, in bridge 16 and engage pulleys, pulley 17 being typical, so that the strings are carried from the front of the body to the back of the body and to tuning machines adjusted by the knobs, knob 18 being typical, on side 19 of the body. Screws 20 and 21 at the ends of the bridge are used to adjust the distances of the ends of the bridge from the front of the body, thus enabling some adjustments of the distances that the strings are away from the pickups; however, these distances cannot be individually adjusted for each string. Also, the effective length of each string is determined by its contact with a roller on the bridge and there is no provision for adjusting the positions of the rollers or the bridge to adjust the effective length of each string. Further, the purposes of making a guitar compact are thwarted somewhat in this guitar because of (1) the distance A from the contact points of the strings on the bridge rollers to their initial contact with the pulleys, (2) the radii R of the pulleys, and (3) the distance B from the peripheries of the pulleys to the end 22 of the body. As noted above, the objectives of the subject inventions are to minimize or eliminate these detractions from the concept of a compact electric guitar.

Figure 2:
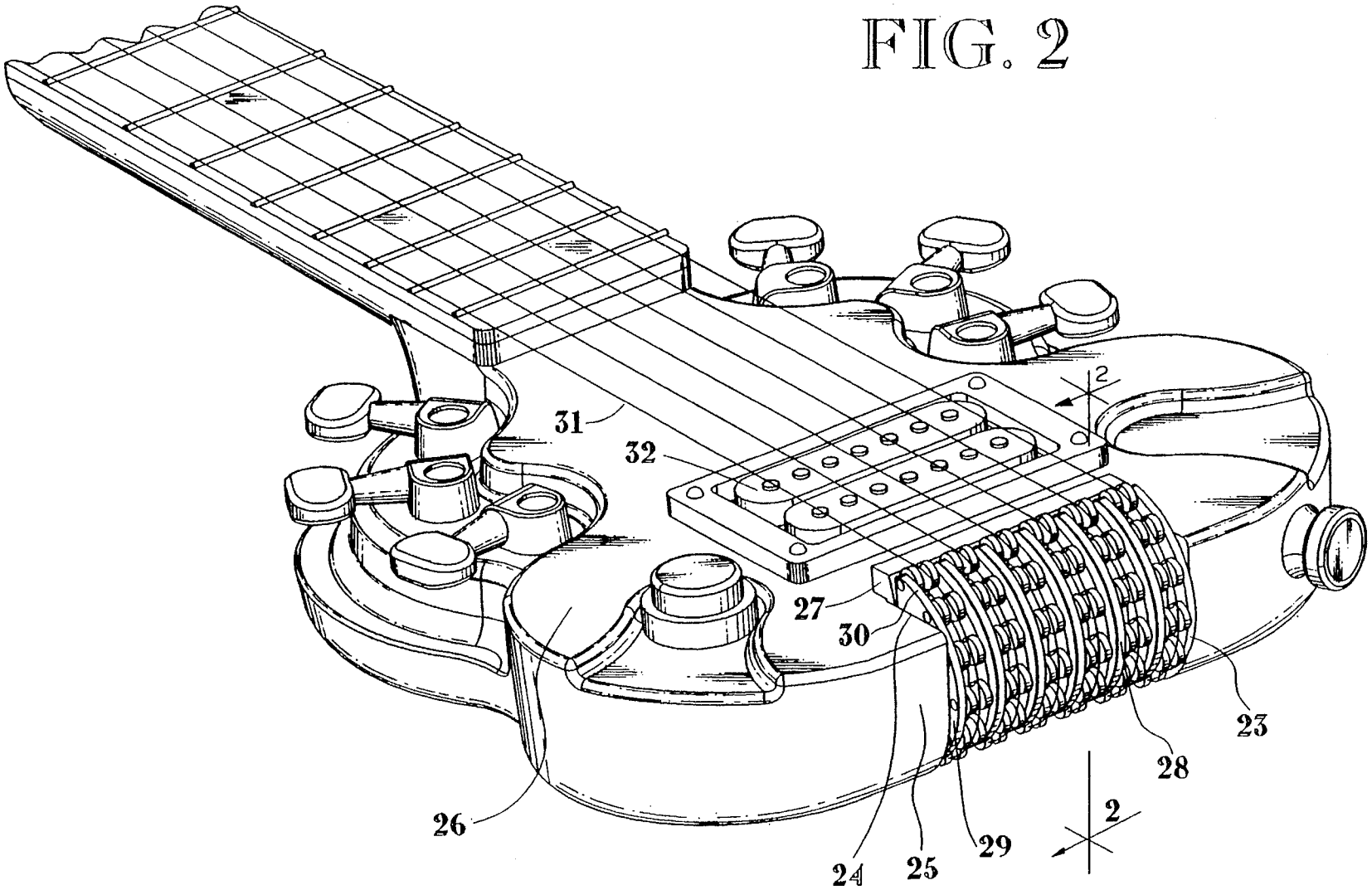
FIG. 2 is a general view of the subject invention installed in a compact guitar, neck truncated, viewed from the top.

FIG. 2 illustrates the subject invention installed in a guitar designed for optimum use of the invention. An assembly 23, termed a carrier assembly, is installed in notch 24 in bottom 25 of body 26. The carrier assembly comprises a base 27 and six roller assemblies, roller assembly 28 being typical. Each roller assembly comprises a carriage, carriage 29 being typical, with each carriage having an upper end 30 which has an inverted V-shape in cross-section with a small radius at the apex of the V-shape. The strings, string 31 being typical, pass over a pick up, pick up 32 being typical, and contact a carriage at its radiused upper end. As explained below, the positions of the top ends of the carriages are independently adjustable in the lengthwise directions of the strings, these adjustments providing individual adjustment of the effective length of each string.

Figure 3:
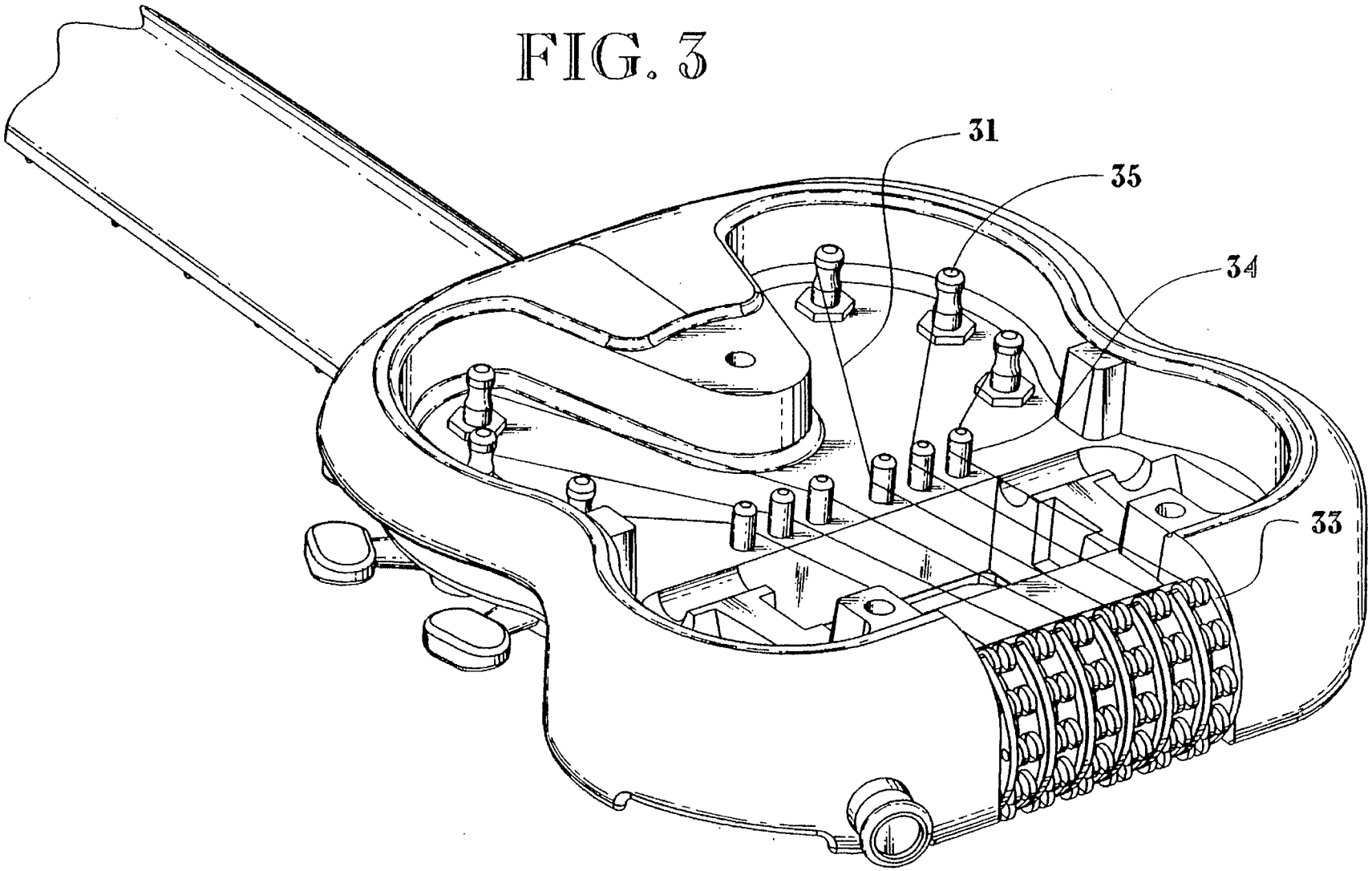
FIG. 3 is a general view of the subject invention installed in a compact guitar, neck truncated, viewed from the bottom.

The roller assemblies, described in more detail below, carry the strings around the bottom of the body to the back of the body, shown in FIG. 3. Each string, such as string 31, leaves the lower end of the roller assembly, end 33 being typical, and is routed from the roller assembly end around a post, post 34 being typical, to a tuning machine, machine 35 being typical.

Figure 4:
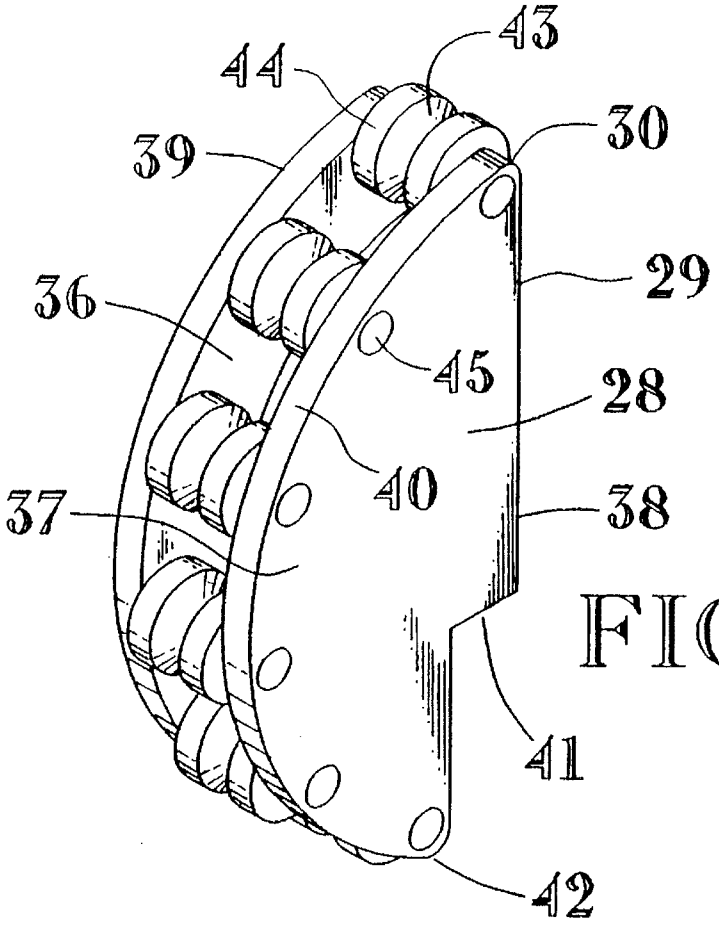
FIG. 4 illustrates a roller assembly with the roller subassemblies in view.

FIG. 4 illustrates roller assembly 28 in more detail. It comprises carriage 29, having upper end 30. The carriage has a U-shaped cross section having sides 36 and 37 and a back face 38. Peripheries 39 and 40 of the sides are portions of a circle so that in side (plan) view the carriage is a chordal portion of a circle except for step 41 in the back face. As shown, the step is about a third of the length of the carriage from the bottom end 42 of the carriage. There are four roller subassemblies in each roller assembly, subassembly 43 being typical. Each roller subassembly comprises a spool shaped roller 44 mounted in the carriage on a shaft 45, press fitted into the roller and riding in holes in the sides of the carriage. The holes are essentially evenly spaced between the top and bottom of the carriage and near the perimeters of the sides.

Figure 5:
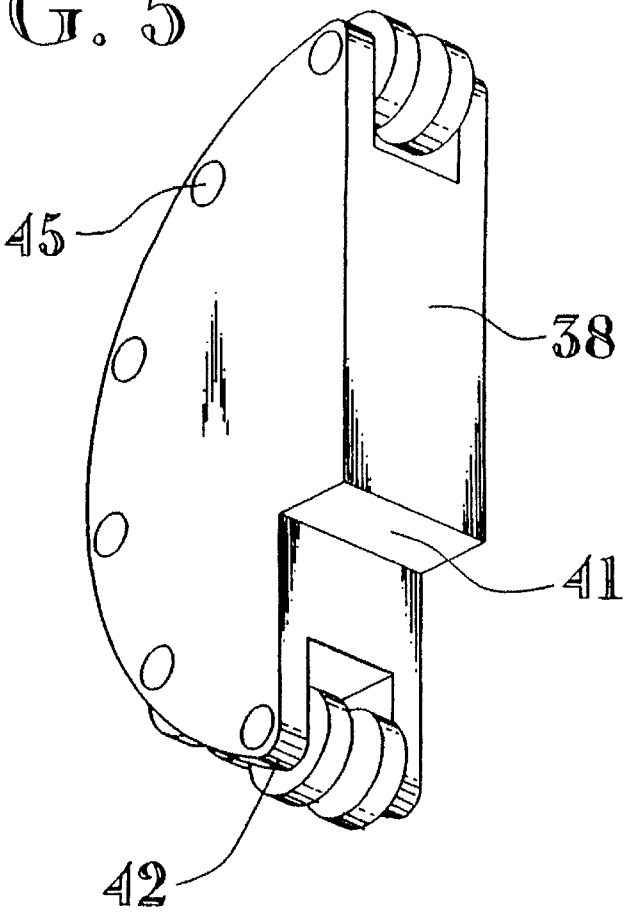
FIG. 5 illustrates a roller assembly showing the stepped face.

FIG. 5 illustrates a roller assembly viewed to show the stepped back face of the carriage.

Figure 6:
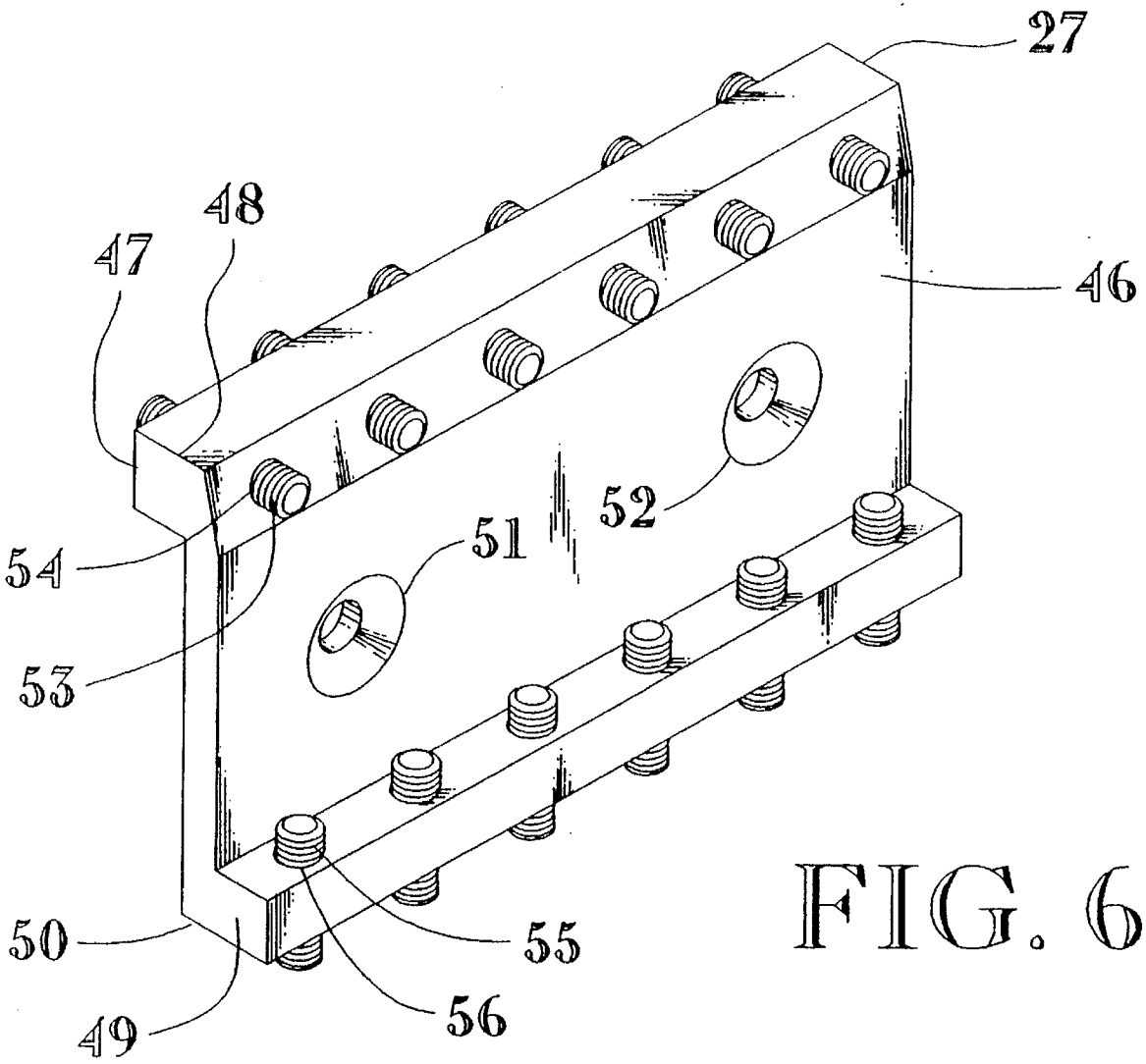
FIG. 6 is a perspective view of the base of the carrier assembly.

FIG. 6 is a perspective view of base 27. The base is basically a rectangular flat plate 46 having a first flange 47 along edge 48 and a second flange 49 along edge 50. Each flange extends at 90° to the flat plate. Holes 51 and 52 accept the fasteners which hold the base to the bottom of the notch in the bottom end of the head. There are six set screws in six threaded holes in flange 47, screw 53 and hole 54 being typical. The axes of these holes are perpendicular to the broad faces of the flat plate. There are also six set screws in six holes in flange 49, screw 55 and hole 56 being typical. The axes of these holes are parallel to the broad surfaces of the plate.

Figure 7:
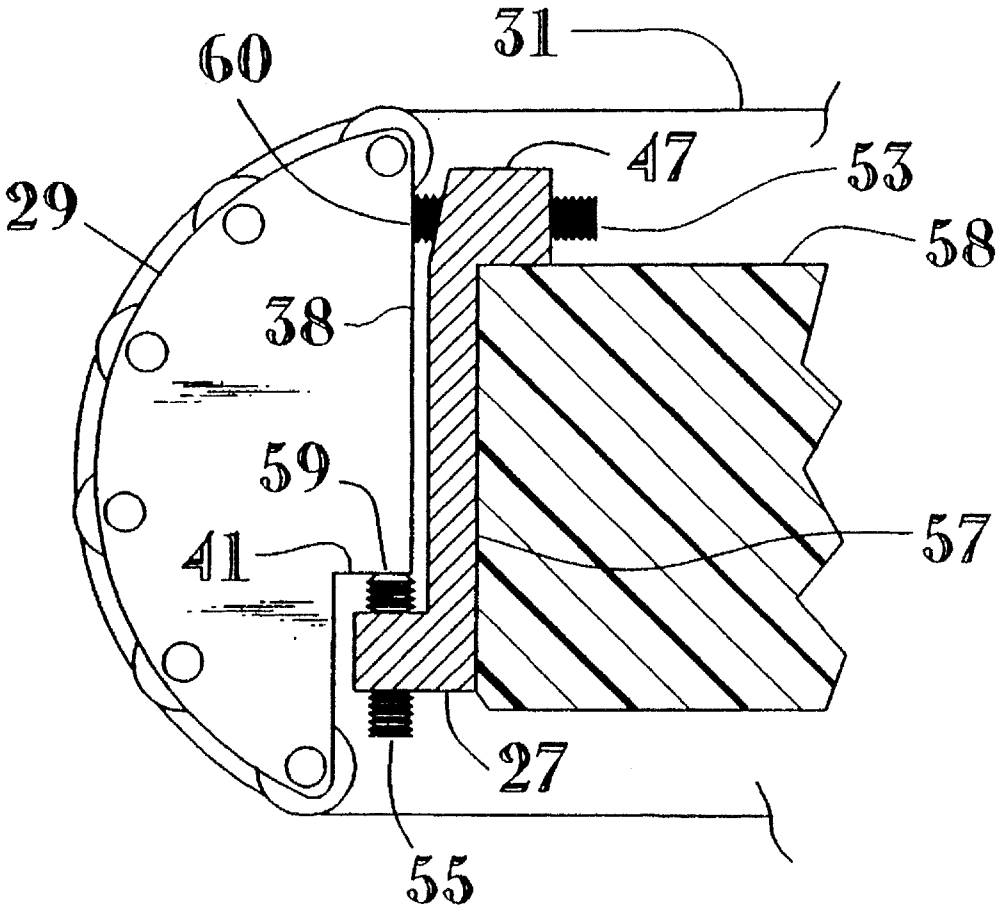
FIG. 7 is a sectional view taken at 7—7 in FIG. 2.

All the holes and screws are aligned so that the screws contact carriages as shown in FIG. 7, a sectional view taken at 7—7 in FIG. 2. Base 27 is in contact with bottom 57 of notch 24 with flange 47 contacting the top surface 58 of the head. Carriage 29 (roller assembly 28) is supported on end 59 of set screw 55 at step 41 and back face 38 is in contact near its upper end with end 60 of set screw 53. The roller assembly is held in place by string 31. Adjusting set screw 53 will adjust the distance of string 31 from surface 58 and therefore from the electronic pickup associated with string 31. Adjusting screw 55 adjusts the upper end of the carriage along string 31, thereby adjusting the effective length of string 41.

It is considered to be understandable from this description that the subject invention meets its objectives. The knobs of the tuning machines of the subject mechanism are readily accessible when the guitar is in playing position. The distance of each string from its associated electronic pick up is independently adjustable. The effective length of each string is independently adjustable and the length of the guitar on which the subject mechanism is installed is only minimally greater than the effective length of the strings.

It is also considered to be understood that while certain embodiments of the subject invention are disclosed herein, other embodiments and modifications of those described are possible within the scope of the invention which is limited only by the attached claims.

I claim:

1. Guitar string installation and adjustment apparatus for installation and use on a guitar having a body and at least one electronic pickup, said at least one string having an effective length and being a distance from said pick up, said body having a front, a back, first and second sides and a top and a bottom, said mechanism comprising a carrier assembly, said assembly being installed on said bottom and carrying said at least one string from said front to said back around said bottom, said assembly further comprising means for adjusting said effective length of said string and said distance.

2. The apparatus of claim 1 having six strings and six tuning machines, said tuning machines being located on said front and spaced along said top and sides.

* * * * *